US006170570B1

(12) United States Patent
Aguesse et al.

(10) Patent No.: US 6,170,570 B1
(45) Date of Patent: Jan. 9, 2001

(54) SINKER BAR FOR CABLE-OPERATED WELL APPARATUS

(75) Inventors: Laurent J. Aguesse, Paris; Jean-Pierre Chyzak, Evry-Gregy sur Yerres; Eric A. Veignat, Palaiseau, all of (FR)

(73) Assignee: Schlumberger Technology Corporation, Houston, TX (US)

( * ) Notice: Under 35 U.S.C. 154(b), the term of this patent shall be extended for 0 days.

(21) Appl. No.: 09/156,908

(22) Filed: Sep. 18, 1998

(30) Foreign Application Priority Data

Sep. 26, 1997 (FR) ..... 97 11988

(51) Int. Cl.[7] ..... E21B 19/02
(52) U.S. Cl. ..... 166/65.1; 166/385; 403/375
(58) Field of Search ..... 166/65.1, 72, 250.01, 166/382, 385; 403/302, 310, 313, 344, 319, 317, 375

(56) References Cited

U.S. PATENT DOCUMENTS

| | | | |
|---|---|---|---|
| 1,476,218 | | 12/1923 | Premro . |
| 4,063,592 | | 12/1977 | Youmans . |
| 4,082,144 | | 4/1978 | Marquis . |
| 4,130,169 | | 12/1978 | Denison . |
| 4,337,969 | * | 7/1982 | Escaron et al. ..... 285/24 |
| 4,624,308 | * | 11/1986 | White ..... 166/65.1 |
| 4,697,641 | | 10/1987 | White . |
| 4,799,546 | | 1/1989 | Hensley et al. . |
| 4,923,011 | * | 5/1990 | Skipper ..... 166/311 |
| 4,971,147 | * | 11/1990 | Thomeer ..... 166/65.1 |
| 4,986,690 | * | 1/1991 | Cooksey ..... 403/319 |
| 5,141,051 | | 8/1992 | Lenhart . |

FOREIGN PATENT DOCUMENTS

| | | |
|---|---|---|
| 0 437 084 A2 | 7/1991 | (EP) . |
| 2 761 111 | 9/1998 | (FR) . |
| 681566 | 10/1952 | (GB) . |
| 2 157 097 | 10/1985 | (GB) . |
| 2 232 196 | 12/1990 | (GB) . |

* cited by examiner

*Primary Examiner*—Roger Schoeppel
(74) *Attorney, Agent, or Firm*—John J. Ryberg; Brigitte L. Jeffery

(57) ABSTRACT

The invention provides a sinker bar for use with a hydrocarbon well apparatus connected to an operating cable through a cable head. The sinker bar includes a bar provided with a longitudinal slot. This slot is adapted to permit lateral engagement of the bar onto the cable, and to connect at one of its ends at the cable head. The bar may also be adapted to connect at its other end to a fishing head. The connection may be twist locked. The invention is applicable in particular with production logging apparatus.

15 Claims, 4 Drawing Sheets

SINKER BAR FOR CABLE-OPERATED WELL APPARATUS

BACHGROUND OF THE INVENTION

1. Field of the Invention

The present invention relates to a sinker bar for a hydrocarbon well apparatus operated by means of a cable.

2. Description of the Prior Art

In the field of oil exploration and extraction, it is often necessary to lower various apparatuses down a hydrocarbon well. Such apparatuses are suspended from a cable driven at the surface by means of a winch.

This applies, for example, when a perforator apparatus is operated to bring a well into operation.

It is also known to perform monitoring or diagnosis functions in hydrocarbon wells that are in operation by lowering measuring apparatuses down such wells. By way of example, one such apparatus is described in French patent application No. 97.03422.

It is also known to use sinker bars whose weight adds to that of the apparatus to make it easier to lower the apparatus down the well. Such sinker bars are often necessary to balance the force, resulting from the pressure prevailing in the well, exerted on the cross-section of the cable.

Sinker bars also make it possible to overcome friction against the inside surface of the well due to the centralizer devices of the apparatus. The cross-section of the apparatus may be smaller than the cross-section of the well and centralizer devices may be used to hold the apparatus on the axis of the well. This applies in particular for inclined wells.

Finally, sinker bars are also effective to exert a sufficient tension on the cable used for operating the apparatus.

Known sinker bars are in the form of a tube provided with a thread at each end. A sinker bar or a set of assembled-together sinker bars is thus screwed at its top end to a cable head and at its bottom end to the apparatus. The operations of screwing and unscrewing sinker bars constitute a first drawback of known devices.

In addition, the cable for operating the apparatus is also used for providing an electrical connection between the apparatus and the surface, e.g. for transmitting data. An electrical connection must therefore be established through sinker bars which are disposed between the apparatus and the cable head. Sinker bars must therefore be fluid-tight and capable of withstanding the pressures prevailing in the well.

As a result, electrical contacts must be present to provide connections between sinker bars, and also between the apparatus and the cable, and seals are required to make the sinker bars fluid-tight. This gives rise to problems of reliability due to loss of insulation or to faulty electrical continuity.

Finally, in inclined wells, a special adapter must be added to provide a ball joint between the sinker bars and the apparatus. Such an arrangement is necessary to avoid the need to center sinker bars, which would require centralizer devices of large mechanical strength.

SUMMARY OF THE INVENTION

There is provided according to the invention a sinker bar for use with a well apparatus connected to an operating cable through a cable head, comprising a bar provided with a longitudinal slot, said slot being adapted to permit lateral engagement of said bar onto said cable, and including first connection means at one of its ends for connection to said cable head.

Thanks to their longitudinal slots, the sinker bars can be mounted on the cable above the member forming the cable head. The cable head can be connected to the apparatus by any appropriate means, in particular by screws, using threads which are provided in existing apparatuses.

A first advantage of the invention is that it eliminates all problems of sealing and electrical contact associated with known sinker bars.

In a particular embodiment, the sinker bar includes at its other end second connection means for connection to a member forming a fishing head.

Fishing heads are known. In the prior art, they comprise members provided with means enabling the apparatus to be extracted without using a cable. Such fishing heads are disposed at the top end of the assembly constituted by the apparatus and its sinker bars, where said assembly is connected to the cable.

Thus, it is also possible to provide for using a fishing head with sinker bars of the invention. Nevertheless, the fishing head is now above the bottom end of the cable, on top of the sinker bars.

Advantageously, the first or second connection means are twist-lock means adapted to engage complementary twist-lock means of said members.

This makes the assembling much simpler and quicker than with the threaded prior art sinker bars.

More particularly, the twist-lock means may comprise a flat twist-lock head adapted to be inserted behind at least one shoulder of said member and to be locked by said shoulder after rotating through about one-fourth of a turn, and locking means for preventing said rotation.

Naturally, the inverse configuration could be adopted, with the twist-lock means then comprising at least one shoulder adapted to receive and lock a twist-lock head of said member.

In practice, it is possible to adopt a combined solution in which the sinker bar is provided with a twist-lock head at one end and with a twist-lock shoulder at its other end. All of the bars are then identical and can be assembled one after another.

Also, in a particular embodiment, said connection means are ball joint means.

There is thus no longer any need, as in the prior art, to provide a ball joint adapter since the axes of two successive sinker bars can be slightly offset in deviated wells.

More particularly, the connection means may include a substantially spherical surface adapted to engage a complementary surface of said member.

When using twist-lock or connection means, the twist-lock means can then possess clearance to make ball joint operation possible.

The invention also provides a method of installing a sinker bar for a hydrocarbon well apparatus operatively connected to a cable through a cable head, comprising the step of engaging the sinker bar laterally onto said cable above the cable head by inserting the cable through a longitudinal slot provided in said bar.

BRIEF DESCRIPTION OF THE DRAWINGS

A particular embodiment of the invention is described below by way of non-limiting example and with reference to the accompanying diagrammatic drawings, in which.

DESCRIPTION OF THE PREFERRED EMBODIMENTS

Figure 1:
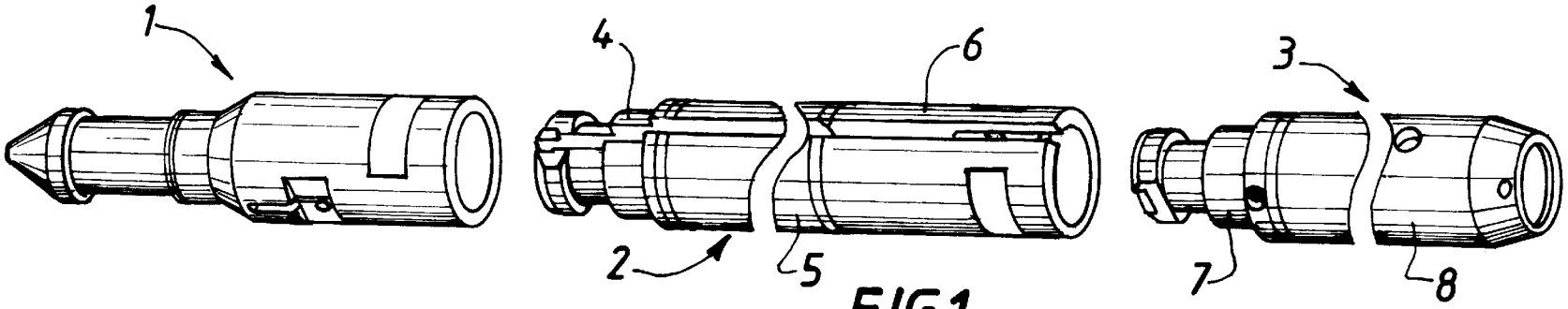
FIG. 1 is a perspective view of an assembly constituted by a fishing head, a sinker bar, and a cable head.

FIG. 1 shows a fishing head 1, a sinker bar 2, and a cable head 3. The sinker bar 2 itself comprises a top endpiece 4, a body 5, and a bottom endpiece 6. Similarly, the cable head 3 comprises a top endpiece 7 and a body 8.

Figure 2:
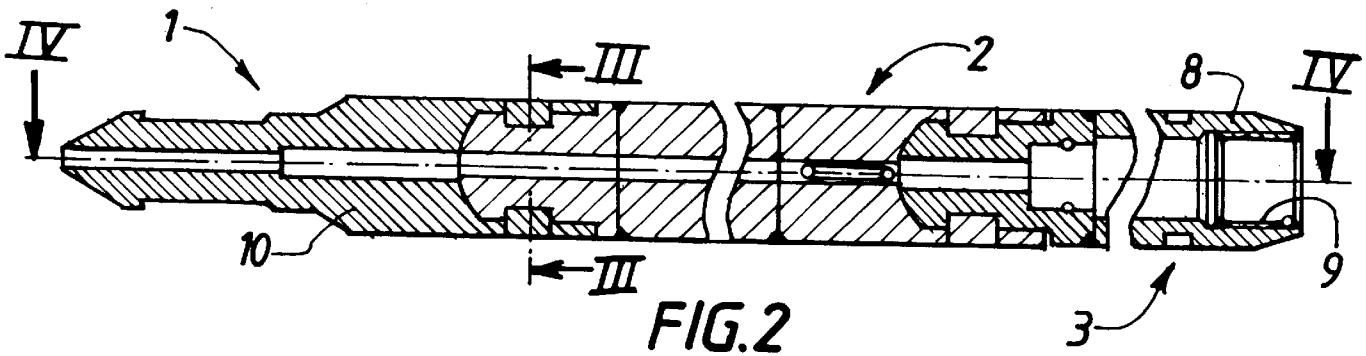
FIG. 2 is a section view on line II—II of FIG. 3 through said assembly after it has been assembled.
Figure 3:
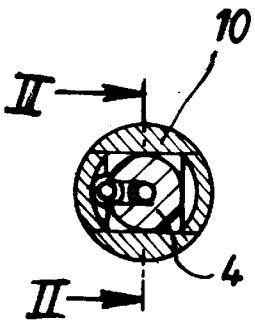
FIG. 3 is a section view on line III—III of FIG. 2.
Figure 4:
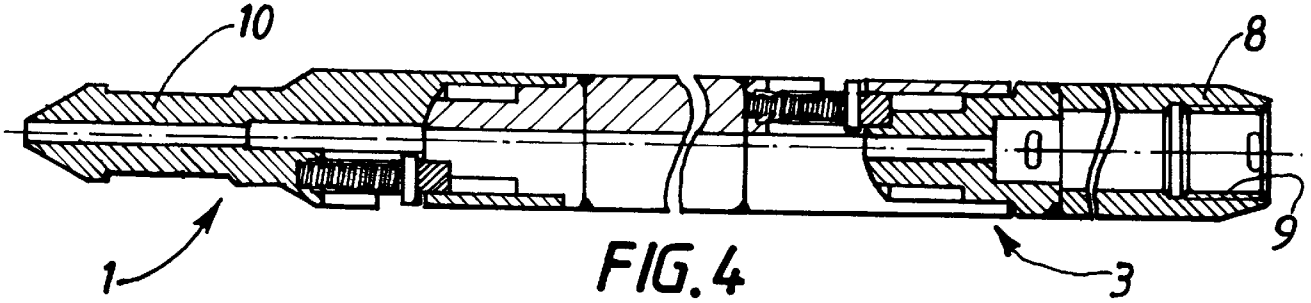
FIG. 4 is a section view on line IV—IV of FIG. 2.

In normal operation, the fishing head 1, one or more sinker bars 2 (or none), and the cable head 3 are assembled together as shown in FIGS. 2 to 4 and are disposed substantially in the longitudinal direction of the well, with the fishing head 1 on the uphole side and the cable head on the downhole side. Below, the term "top" is used for the lefthand side of the figures (uphole) and "bottom" for the righthand side (downhole).

A threaded bore 9 formed inside the body 8 of the cable head 3 is provided for securing to the bottom of that assembly a hydrocarbon well apparatus, not shown, which may be constituted in particular by a perforator apparatus or a measuring apparatus. A cable, not shown, adapted for operating the apparatus as conventional in the art (i.e. the apparatus is suspended from the cable and hence displaceable through the well by the cable, and electrically operated by the same), has its lower end fixed in conventional manner to the cable head 3. The cable passes through the sinker bar(s) 2 and then through the fishing head 1, and at the surface it is wound on a winch, not shown, located near the well-head.

Figure 5:
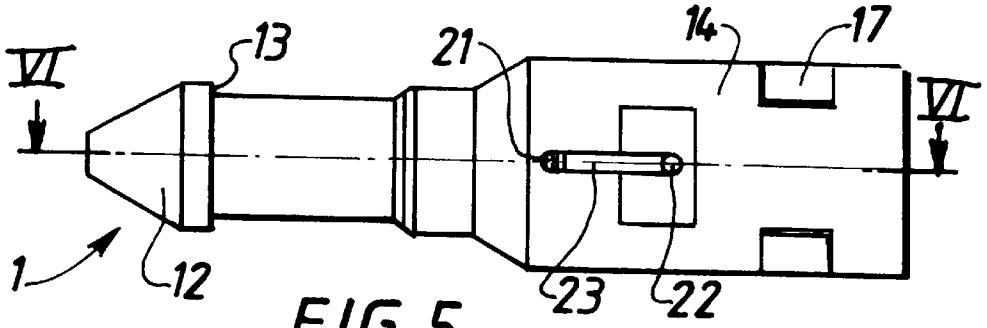
FIG. 5 is an elevation view on a larger scale of the fishing head of FIG. 1.
Figure 6:
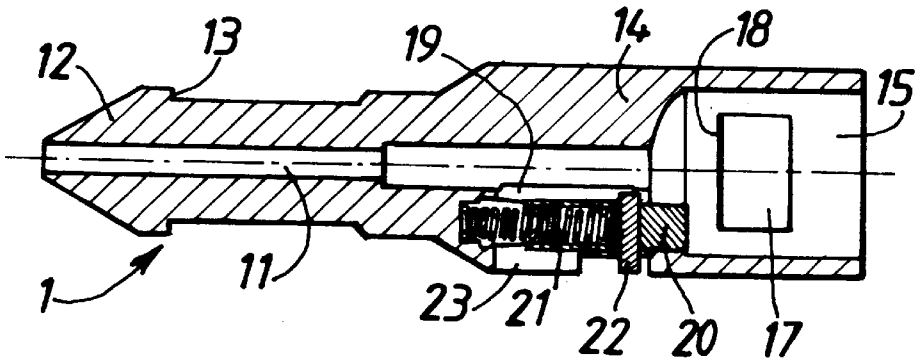
FIG. 6 is a section view on line VI—VI of FIG. 5.
Figure 7:
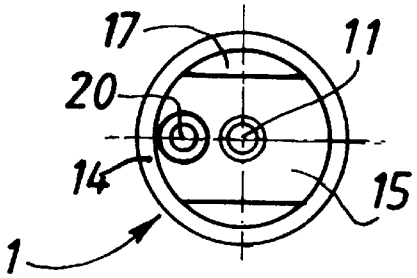
FIG. 7 is a bottom view of the fishing head of FIG. 5.
Figure 8:
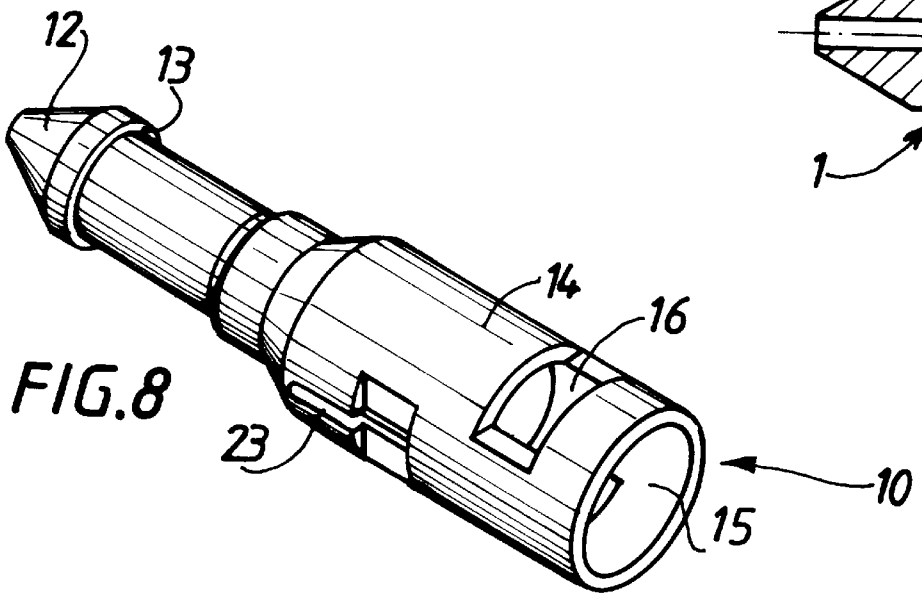
FIG. 8 is a perspective view.
Figure 12:
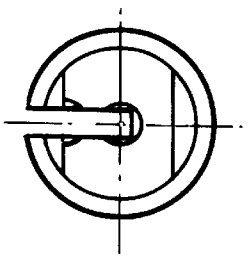
FIG. 12 is a top view of the sinker bar.
Figure 9:
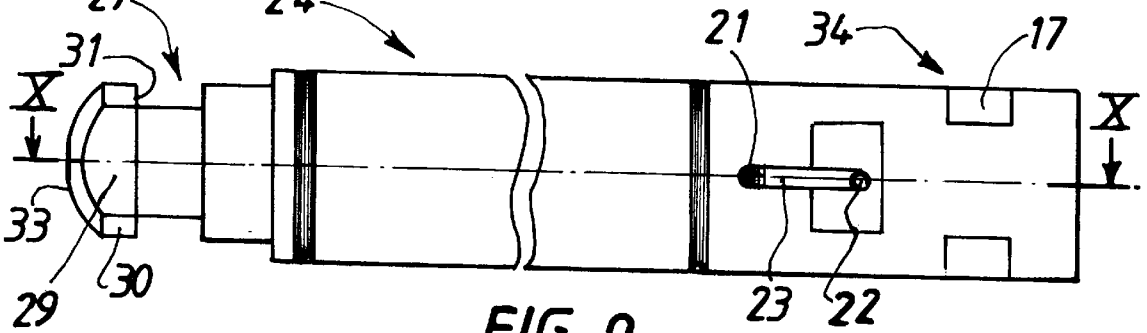
FIG. 9 is an elevation view of the sinker bar of FIG. 1.
Figure 10:
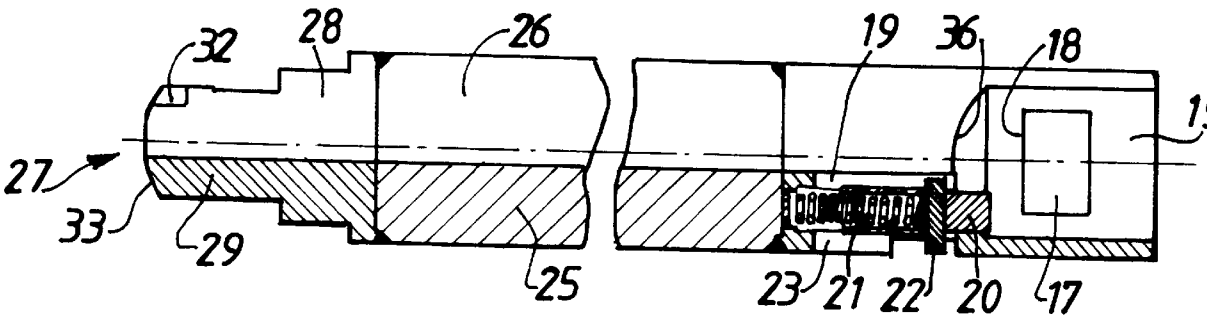
FIG. 10 is a section view on line X—X of FIG. 9.
Figure 14:
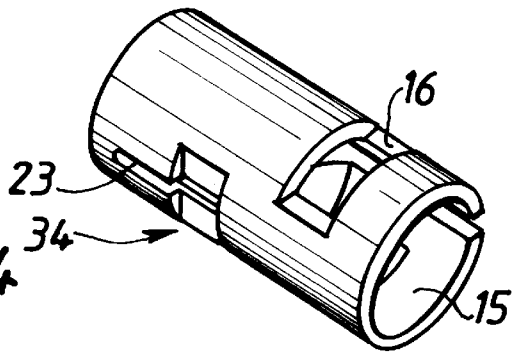
FIG. 14 is a perspective view of its bottom endpiece.
Figure 11:
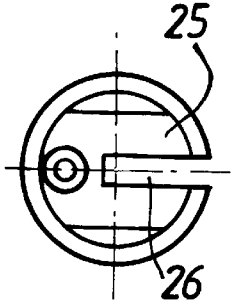
FIG. 11 is a bottom view of the sinker bar of FIG. 9.
Figure 13:
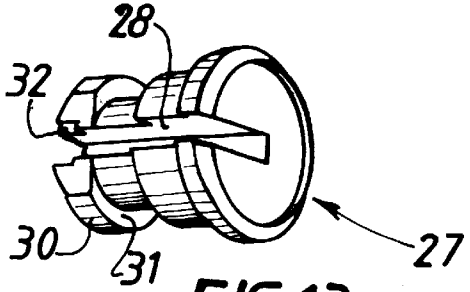
FIG. 13 is a perspective view of the top endpiece of the sinker bar of FIG. 9.
Figure 15:
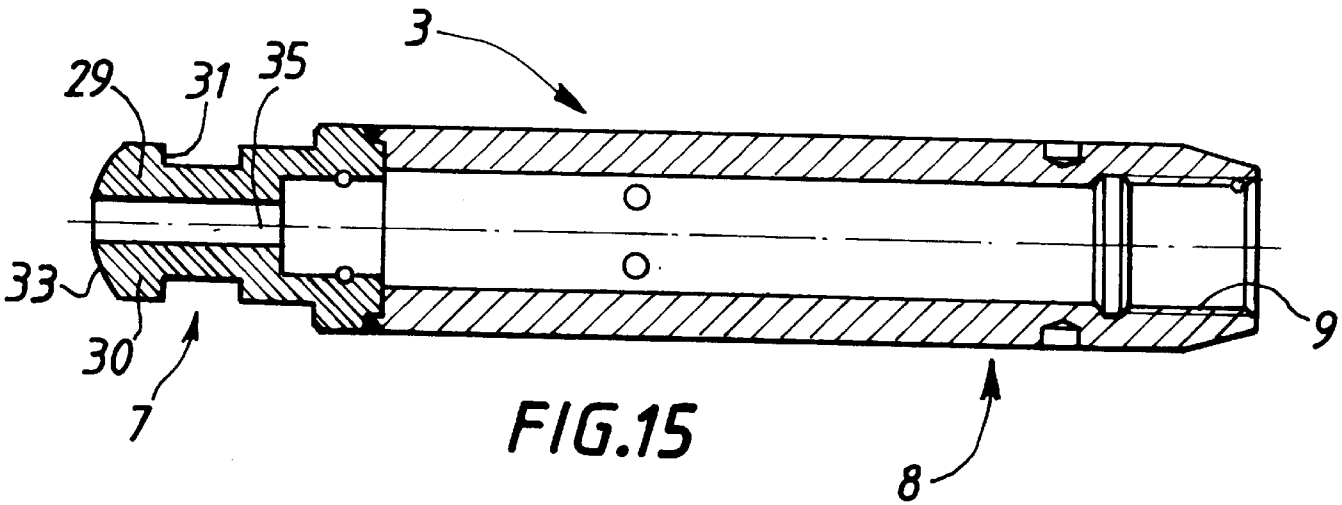
FIG. 15 is an axial section view of the cable head of FIG. 1.
Figure 17:
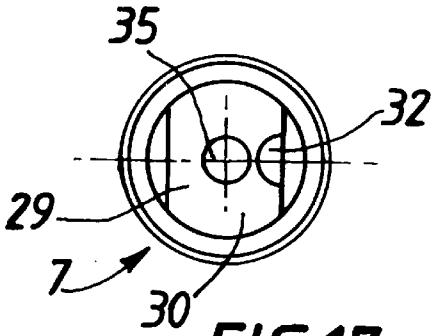
FIG. 17 is a top view of the cable head of FIG. 15.
Figure 16:
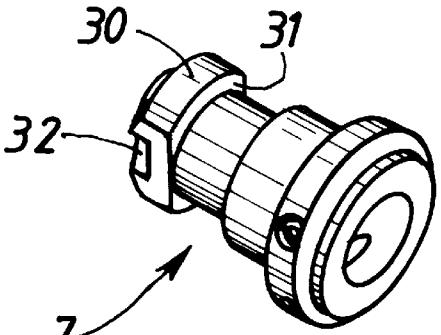
FIG. 16 is a perspective view of the top endpiece of the cable head.

The fishing head 1 is shown in detail in FIGS. 5 to 7. FIG. 8 shows only the body 10 of the fishing head. The body 10 is substantially axisymmetrical with an axial bore 11 through which the operating cable passes.

The top portion 12 of the body 10 is conical, having a shoulder 13 that faces downwards. The shoulder 13 makes it possible to take hold of the assembly constituted by the apparatus, the cable head, and the sinker bars in order to extract it from the well, should that be necessary.

The bottom portion 14 of the body 10 has a downwardly open cavity 15 for receiving the head of a sinker bar or of the cable head, and as described below. The top end wall of the cavity 15 is spherical and forms the female portion of a ball joint.

During manufacture of the body 10 of the fishing head 1, two orifices 16 are pierced through the wall of the cavity 15. Closure pieces 17 are subsequently welded in these orifices, which pieces project into the inside of the cavity 15 to form upwardly-directed shoulders 18. It is shown hereinafter that these shoulders 18 are used as an engagement surface for the above-mentioned heads of the sinker bars or of the cable head.

The body 10 is provided with a hole 19 whose axis is substantially parallel to the axis of the body. The hole 19 is open at its bottom end and opens out into the cavity 15. A locking finger 20 is disposed in the hole 19 so as to be capable of projecting into the cavity 15 towards which it is urged by a spring 21 bearing at one end against the finger 20 and at its other end against the end wall of the hole 19. Finally, a lug 22 secured to the finger 20 and extending substantially perpendicularly to the axis thereof projects outside the body 10 via a longitudinal slot 23. It is shown below how the finger 20 serves to lock the head of a sinker bar or of the cable head in the cavity 15.

A sinker bar as shown in FIGS. 9 to 12 is made up of three welded-together portions. The central portion 24 provides the required weight proper and is constituted by a bar 25 having a longitudinal slot 26 of generally U-shaped cross-section extending across its entire length. The width of slot 26 is such as to permit passage of the cable therethrough until engagement of the cable with the bottom surface of the slot. Thereby the central portion 24 can be laterally mounted onto the cable.

The top endpiece 27 of the sinker bar is a member that is substantially axisymmetrical, having a longitudinal slot 28 in line with the slot 26. At its end, the endpiece 27 forms a head 29 provided with two lateral projections 30 that form downwardly-facing shoulders 31.

The head 29 also includes a notch 32 which serves to receive the end of a locking finger 20, as described below. Finally, the upwardly-facing surface 33 of the head 29 is substantially spherical.

The third element of the sinker bar is a bottom endpiece 34. The bottom endpiece 34 is similar to the body 14 of the fishing head 1 and is therefore not described. The same references have been used for corresponding members in the figures showing the sinker bar and the figures showing the fishing head.

As mentioned above, the cable head 3 comprises an endpiece 7 and a body 8, the body having a thread 9 for connection to the apparatus. These two elements are welded together and include conventional means for receiving and securing the end of the operating cable.

The endpiece 7 is similar to the endpiece 27 of the sinker bar and the same reference numerals are used for corresponding elements in the figures showing the sinker bar and those showing the cable head endpiece.

However, it should be observed that the top endpiece 7 is not slotted like the endpiece 27, but is provided with an axial hole 35 opening out into the tubular body 8 of the cable head.

The operation of the invention is described below.

The fishing head 1 is initially engaged on the operating cable and the electrical connection whose end is subsequently fixed in known manner to the cable head 3. The fishing head may optionally be fixed directly to the cable head, as described below.

It is also possible to install one or more sinker bars. This is done by raising the fishing head so as to release an appropriate length of cable, and then placing said length of cable in the slot 26 of the sinker bar. Thereafter the bottom portion of the sinker bar is fixed to the cable head, and finally the fishing head is fixed to the top portion of the sinker bar.

Both of these fixing operations are performed in the same manner, so only the operation of fixing the sinker bar to the cable head will be described.

To this end, the head 29 of the endpiece 3 is engaged between the pieces 17 of the sinker bar until the shoulders 31 go beyond the shoulders 18. During this operation, the finger 20 is pushed back into the hole 19 of the sinker bar against the action of the spring 21.

The sinker bar is then rotated through one-fourth of a turn until the finger 20 comes level with the notch 32 and is engaged therein under thrust from the spring 21. The sinker bar is thus locked and prevented from rotating by the finger 20 engaged in the notch 32, and is prevented from moving in translation by the shoulders 31 engaging the shoulders 18.

Nevertheless, it will be observed that such engagement takes place only when traction is exerted on the sinker bar. Sufficient clearance is provided between the sinker bar and the cable head endpiece to allow for a small amount of relative axial movements between these two elements by co-operation between the spherical surfaces 33 of the cable head and 36 of the end wall of the cavity 15.

Finally, the fishing head is fixed to the sinker bar in the same manner.

To disassemble the sinker bar, the lug 22 is pushed against the action of the spring 21 so as to extract the finger 20 from the notch 32. The sinker bar is then free to rotate and it is rotated through one-fourth of a turn so as to offset the shoulders 18 and 31, thereby enabling the sinker bar to be extracted.

What is claimed is:

1. A sinker bar for use with a well apparatus connected to an operating cable through a member forming cable head, comprising a bar provided with a longitudinal slot, said slot being adapted to permit lateral engagement of said bar onto said cable, and including first connection means at one of its ends for connection to said cable head member.

2. A sinker bar according to claim 1, including at its other end second connection means for connection to a member forming fishing head.

3. A sinker bar according to claim 2 in which at least the first or second connection means are twist-lock means adapted to engage complementary twist-lock means of said member.

4. A sinker bar according to claim 3, in which said twist-lock means comprise a flat twist-lock head adapted to be engaged behind at least one shoulder of said member and to be locked by said shoulder after rotating through about one-fourth of a turn, and locking means for preventing said rotation.

5. A sinker bar according to claim 3 wherein said connection means are ball joint means and wherein said twist-lock means possess clearance allowing the ball joint to operate.

6. A sinker bar according to claim 3 wherein said connection means comprises a substantially spherical surface adapted to co-operate with a complementary surface of said member and wherein said twist-lock means possess clearance allowing said substantially spherical surfaces to operate.

7. A sinker bar according to claim 3, in which said twist-lock means comprise at least one shoulder adapted to receive and block a twist-lock head of said member.

8. A sinker bar according to claim 2 in which at least the first or second connection means are twist-lock means adapted to engage complementary twist-lock means of said member.

9. A sinker bar according to claim 8, in which said twist-lock means comprise a flat twist-lock head adapted to be engaged behind at least one shoulder of said member and to be locked by said shoulder after rotating through about one-fourth of a turn, and locking means for preventing said rotation.

10. A sinker bar according to claim 8 in which said twist-lock means comprise at least one shoulder adapted to receive and block a twist-lock head of said member.

11. A sinker bar according to claim 8 wherein said connection means comprises a substantially spherical surface adapted to co-operate with a complementary surface of said member and wherein said twist-lock means possess clearance allowing said substantially spherical surfaces to operate.

12. A sinker bar according to claim 8 wherein said connection means are ball joint means and wherein said twist-lock means possess clearance allowing the ball joint to operate.

13. A sinker bar according to claim 1, in which said connection means are ball joint means.

14. A sinker bar according to claim 13, in which said connection means includes a substantially spherical surface adapted to co-operate with a complementary surface of said member.

15. A method of installing a sinker bar for a hydrocarbon well apparatus operatively connected to a cable through a cable head, comprising the step of engaging the sinker bar laterally onto said cable above the cable head by inserting the cable through a longitudinal slot provided in said bar.

* * * * *